US007303092B2

(12) United States Patent
Sarbo et al.

(10) Patent No.: US 7,303,092 B2
(45) Date of Patent: Dec. 4, 2007

(54) WET WIPE PACKAGE

(75) Inventors: Benjamin Charles Sarbo, Winneconne, WI (US); Walter George Bauer, Neenah, WI (US); Wen Zyo Schroeder, Appleton, WI (US); Ryan Leslie Fulscher, Neenah, WI (US); Wichnart Ann Imsangjan, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 17 days.

(21) Appl. No.: 11/023,717

(22) Filed: Dec. 28, 2004

(65) Prior Publication Data

US 2006/0151518 A1 Jul. 13, 2006

(51) Int. Cl.
*A47K 10/24* (2006.01)

(52) U.S. Cl. ..... 221/46; 221/49; 221/63

(58) Field of Classification Search ..... 221/63, 221/46, 49

See application file for complete search history.

(56) References Cited

U.S. PATENT DOCUMENTS 3,161,336 A 12/1964 Loescher
3,239,097 A 3/1966 Bates et al.
3,263,807 A 8/1966 Fingerhut
3,266,666 A 8/1966 Nelson
3,349,993 A 10/1967 Ells et al.
3,369,699 A 2/1968 Enloe et al.
3,684,086 A 8/1972 Harrison
3,784,055 A * 1/1974 Anderson ..... 221/46
3,918,608 A * 11/1975 Faller ..... 221/63
3,979,019 A 9/1976 Bliss
4,143,762 A 3/1979 Spiegelberg
4,156,493 A 5/1979 Julius
4,181,225 A 1/1980 Spiegelberg
4,356,950 A 11/1982 Benham
4,638,921 A 1/1987 Sigl et al.
4,785,970 A * 11/1988 Engelmayer ..... 221/47
4,848,575 A 7/1989 Nakamura et al.

(Continued)

FOREIGN PATENT DOCUMENTS

EP 0 331 027 B1 1/1992

(Continued)

OTHER PUBLICATIONS

American Society for Testing Materials (ASTM) Designation: D 790-99, "Standard Test Methods for Flexural Properties of Unreinforced and Reinforced Plastics and Electrical Insulating Materials," pp. 150-158, published Feb. 2000.

(Continued)

*Primary Examiner*—Gene O. Crawford
*Assistant Examiner*—Timothy Waggoner
(74) *Attorney, Agent, or Firm*—Scott A. Baum

(57) ABSTRACT

A wet wipes package including an outer carton having an opening. Disposed within the carton is an interior tub having a baffle and an aperture located in the baffle. A rigid flip top is disposed over the carton opening for access to the interior tub and a plurality of wet wipes is disposed within the interior tub beneath the baffle. Because the exterior of the wet wipes package is similar to a facial tissue carton, similar graphical treatments as applied to facial tissue cartons can be used to design an attractive package.

24 Claims, 9 Drawing Sheets

U.S. PATENT DOCUMENTS

| | | | | |
|---|---|---|---|---|
| 4,865,221 | A | 9/1989 | Jackson et al. | |
| 4,971,220 | A | 11/1990 | Kaufman et al. | |
| 5,050,737 | A * | 9/1991 | Joslyn et al. | 221/46 |
| 5,259,550 | A | 11/1993 | Kuchenbecker | |
| 5,284,703 | A | 2/1994 | Everhart et al. | |
| 5,295,579 | A | 3/1994 | Focke et al. | |
| 5,316,177 | A | 5/1994 | Boldt | |
| 5,389,202 | A | 2/1995 | Everhart et al. | |
| 5,390,820 | A | 2/1995 | Wright et al. | |
| 5,415,320 | A | 5/1995 | North et al. | |
| D366,830 | S | 2/1996 | Christianson | |
| 5,501,323 | A | 3/1996 | Denesha et al. | |
| 5,507,130 | A | 4/1996 | Young et al. | |
| 5,516,001 | A | 5/1996 | Muckenfuhs et al. | |
| 5,520,308 | A | 5/1996 | Berg, Jr. et al. | |
| 5,531,325 | A * | 7/1996 | Deflander et al. | 221/49 |
| 5,560,514 | A | 10/1996 | Frazier | |
| 5,622,281 | A | 4/1997 | Annand | |
| 5,642,602 | A | 7/1997 | Young et al. | |
| 5,644,897 | A | 7/1997 | Young et al. | |
| 5,687,875 | A | 11/1997 | Watts et al. | |
| 5,810,200 | A | 9/1998 | Trokhan | |
| 5,884,804 | A | 3/1999 | King | |
| D414,637 | S | 10/1999 | Amundson et al. | |
| 6,053,357 | A * | 4/2000 | Yoh | 221/63 |
| 6,065,591 | A | 5/2000 | Dill et al. | |
| 6,273,359 | B1 | 8/2001 | Newman et al. | |
| 6,286,713 | B1 | 9/2001 | Chan et al. | |
| 6,318,555 | B1 | 11/2001 | Kuske et al. | |
| 6,349,849 | B1 | 2/2002 | Pehr | |
| 6,417,114 | B2 | 7/2002 | Tanabe et al. | |
| 6,460,727 | B1 | 10/2002 | Irwin | |
| 6,491,165 | B2 | 12/2002 | Kuske et al. | |
| 6,499,626 | B1 | 12/2002 | Julius | |
| 6,523,690 | B1 | 2/2003 | Buck et al. | |
| 6,592,004 | B2 | 7/2003 | Huang et al. | |
| 6,769,227 | B2 * | 8/2004 | Mumpower et al. | 428/36.6 |
| 6,959,834 | B2 | 11/2005 | McDonald | |
| 2004/0099679 | A1 * | 5/2004 | Welchel et al. | 221/34 |
| 2005/0011906 | A1 | 1/2005 | Buck et al. | |

FOREIGN PATENT DOCUMENTS

| | | | |
|---|---|---|---|
| EP | 0 930 243 | A1 | 7/1999 |
| EP | 0 925 053 | B1 | 1/2003 |
| JP | 09-142551 | A | 6/1997 |
| JP | 11-227853 | A | 8/1999 |
| WO | WO98/29018 | A1 | 7/1998 |
| WO | WO 02/21988 | A1 | 3/2002 |
| WO | WO 02/096775 | A1 | 12/2002 |
| WO | WO 2003/057591 | | 7/2003 |
| WO | WO 2003/076298 | | 9/2003 |

OTHER PUBLICATIONS

American Society for Testing Materials (ASTM) Designation: D 882-02, "Standard Test Method for Tensile Properties of Thin Plastic Sheeting," pp. 1-10, published Jun. 2002.

TAPPI Official Test Method T 411 om-97, "Thickness (Caliper) of Paper, Paperboard, and Combined Board," published by the TAPPI Press, Atlanta, Georgia, revised 1997, pp. 1-4.

TAPPI Official Test Method T 494 om-01, "Tensile Properties Of Paper And Paperboard (Using Constant Rate Of Elongation Apparatus)," published by the TAPPI Press, Atlanta, Georgia, revised 2001, pp. 1-9.

* cited by examiner

WET WIPE PACKAGE

BACKGROUND

Wet wipe products are continuing to increase in popularity. Various packaging formats for wet wipes are available; yet, most people using wet wipe products tend to hide the wipes' package from view. A possible explanation for this behavior is that wet wipe packages are viewed as utilitarian—designed primarily for reliable dispensing and adequate moisture retention without much thought given towards making the package aesthetically desirable.

Wet wipes packages have not achieved widespread acceptance for openly displaying them unlike facial tissue packaging. For example, facial tissue packaged in either a regular or a boutique carton comes in a wide variety of attractive designer prints to complement various home décors. Many people will select cartons of facial tissue for use based primarily on the cartons' graphics instead of the type of tissue or the particular brand. Thus, what is needed is a wet wipes package that is convenient to use and that is attractive for displaying openly.

SUMMARY

In response to the difficulties and problems discussed above, a new package for wet wipes that has improved storage and dispensing and improved aesthetics has been invented. The package utilizes a carton having a rigid flip top for convenient access to the wipes, which are disposed in an interior tub housed within the carton. The interior tub has an attached baffle. Because the exterior of the package is similar to a facial tissue carton, similar graphical treatments as applied to facial tissue cartons can be used to design an attractive wet wipes package.

Hence, in one aspect, the invention resides in a product including: an outer carton having an opening; an interior tub having a baffle and an aperture located in the baffle; a rigid flip top disposed over the carton opening for access to the interior tub; and a plurality of wet wipes disposed within the interior tub beneath the baffle. Additional purposes and features of the present invention will be set forth in and are apparent from the written description, the drawings, and the claims, as well as will be learned by practice of the invention.

BRIEF DESCRIPTION OF THE DRAWINGS

The above aspects and other features, aspects, and advantages of the present invention will become better understood with regard to the following description, appended claims, and accompanying drawings in which:

FIG. 13 is a perspective view of a folded wet wipe.

FIG. 14 is an end view of a stack of multiple wipes folded as shown in FIG. 13.

Figure 1:
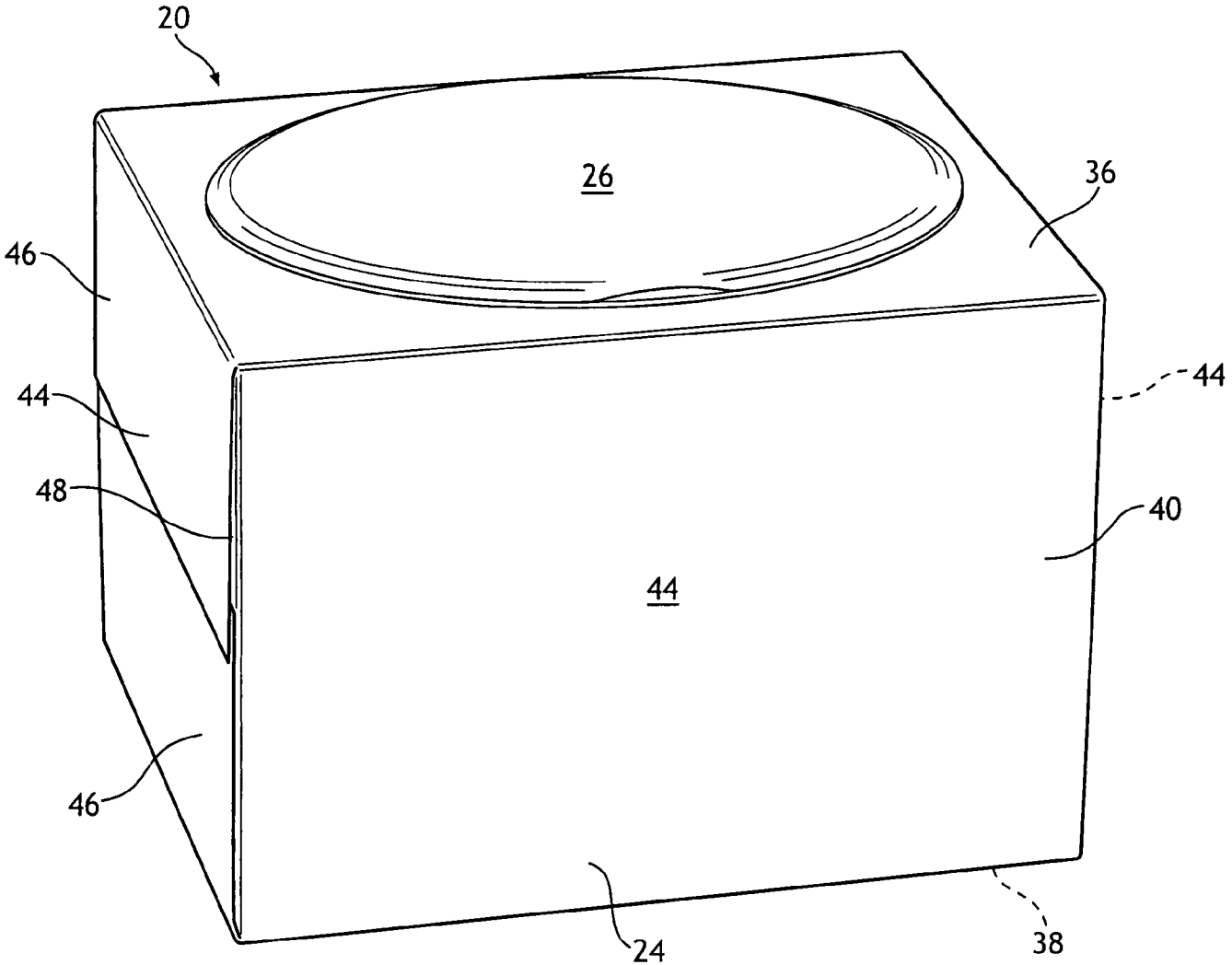
FIG. 1 illustrates a perspective view of an attractive wet wipes container.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps, or limitations may be present in addition to the recited elements, functions, steps, or limitations.

As used herein, "rigid" means a level of stiffness commonly associated with materials used to manufacture wet wipes interior tubs of parts thereof. Numerically, these materials typically have a flexural modulus (as measured in accordance with ASTM D790 "Standard Test Method for Flexural Properties of Unreinforced and Reinforced Plastics and Electrical Insulating Materials") of about 100 Newtons per square millimeter or greater, more specifically from about 1100 to about 1550 Newtons per square millimeter.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 2:
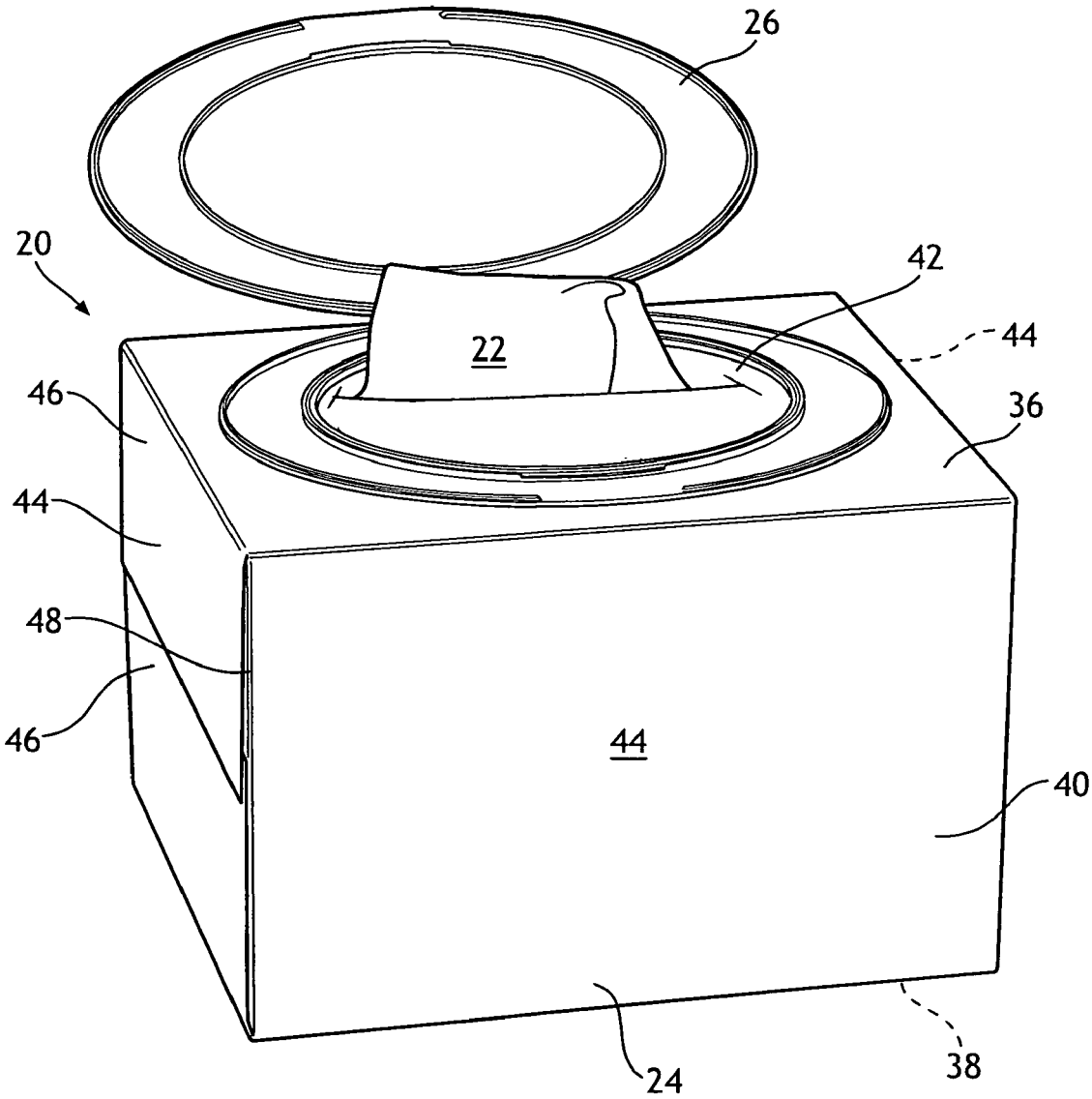
FIG. 2 illustrates a perspective view of the container of FIG. 1 with a rigid flip top opened and a partially dispensed wet wipe.
Figure 3:
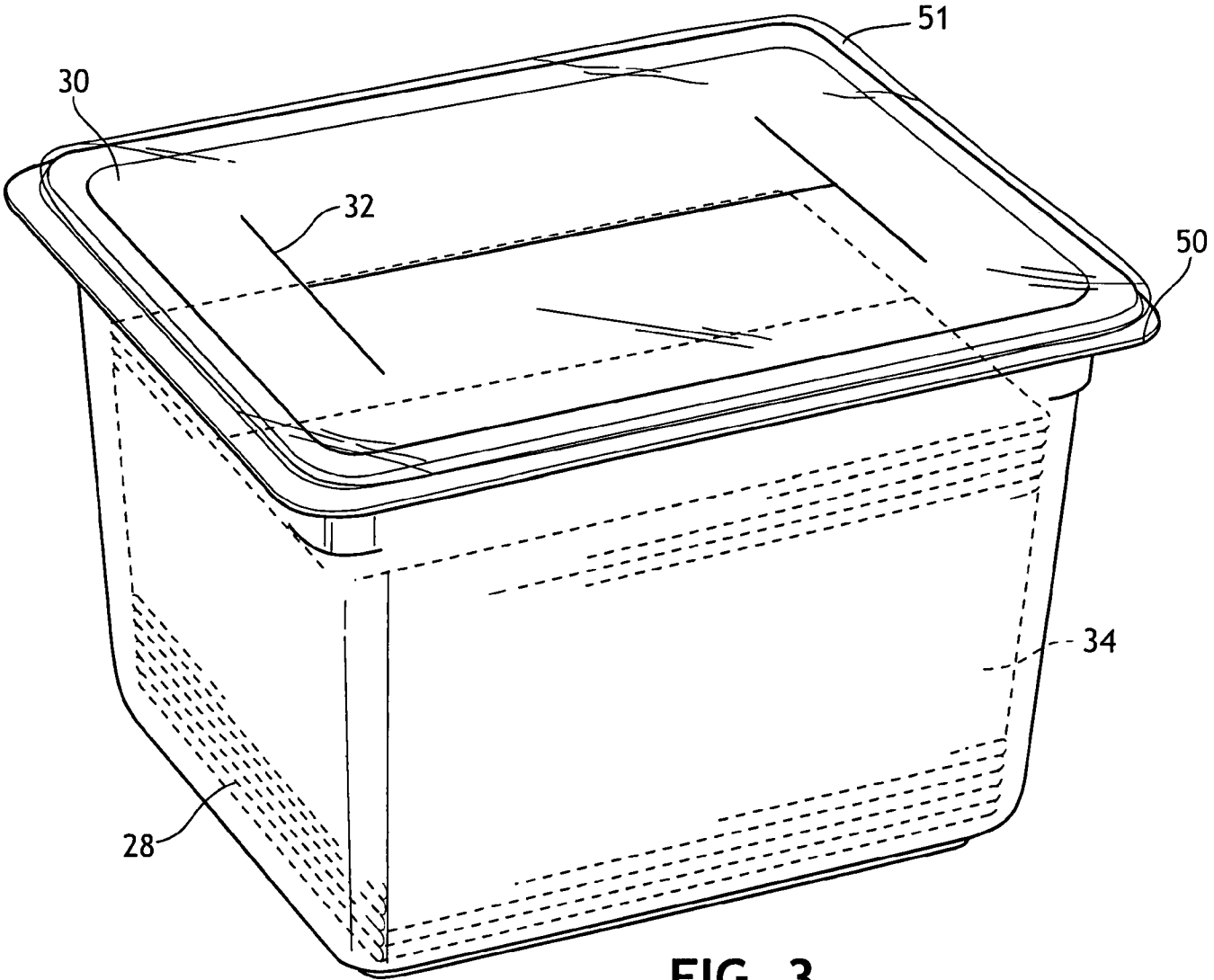
FIG. 3 illustrates a perspective view of an interior tub housed within the outer carton.

Referring now to FIGS. 1, 2, and 3, an attractive container 20 for wet wipes 22 is shown. The container 20 includes an outer carton 24, a rigid flip top 26 attached to the carton, and an interior tub 28 disposed within the carton. The interior tub 28 includes a baffle 30 having an aperture 32. Disposed within the interior tub is a stack 34 of wet wipes 22.

Outer Carton

The outer carton 24 includes a top 36, a bottom 38, and a sidewall 40. An opening 42 is located in the top. Alternatively, the opening 42 into the carton's interior could be located in the bottom, or the sidewall. The carton can be any size or shape and its overall size is influenced by the size of the wet wipes being dispensed, the folded configuration of the wipes, and the number of wipes contained by the container. In a desired embodiment, the carton is a parallelepiped having an overall size similar to a boutique facial tissue carton. In a particular embodiment, the carton was approximately 95 mm in height, 120 mm in depth, and 140 mm in width.

If the carton is a parallelepiped, the carton's sidewall can comprise four panels 44 disposed at approximately 90 degree angles to each other. For ease of automated loading of the interior tub 28 into the carton, the carton can be designed with a plurality of major closing flaps 46 and a plurality minor closing flaps 48. For example, the right and left panels 44 in FIG. 1 can each comprise four closing flaps—two minor closing flaps 48 that are first folded shut and two major closing flaps 46 (one shown) that are folded over the minor closing flaps and glued into position to form the panel 44. Alternatively, the closing flaps can be located on the top 36 and/or the bottom 38 of the carton. Other conventionally known methods of carton construction can be utilized such as a wrap around carton or a carton adapted for opening and closing.

The carton can be constructed of paper board, cardboard, or other cellulosic materials such as SBS, Solid Bleached Sulfate; CCNB, Clay Coated News Back; or SUS, Solid Unbleached Sulfate. Typical thickness of suitable paper board materials can range between about 18 to about 24 point.

The exterior of the carton is adaptable to a wide variety of graphical effects as commonly used for facial tissue cartons. Possible commercially suitable aesthetics include images, printing, indicia, graphics, Fresnel lens, lenticular lens, colors, an embossed area, a debossed area, and/or coating(s). Thus, an aesthetically pleasing container for wet wipes is possible. Because the wipes are housed in a separate interior tub, the graphics of the carton can be quickly changed. Cartons having various designs can be supplied and combined with the common interior tub to produce a wide variety of containers. Additionally, the carton's graphics can be matched or complementary to the graphics used on facial tissue dispensers, napkin holders, or other disposable product packages.

Interior Tub

Figure 4:
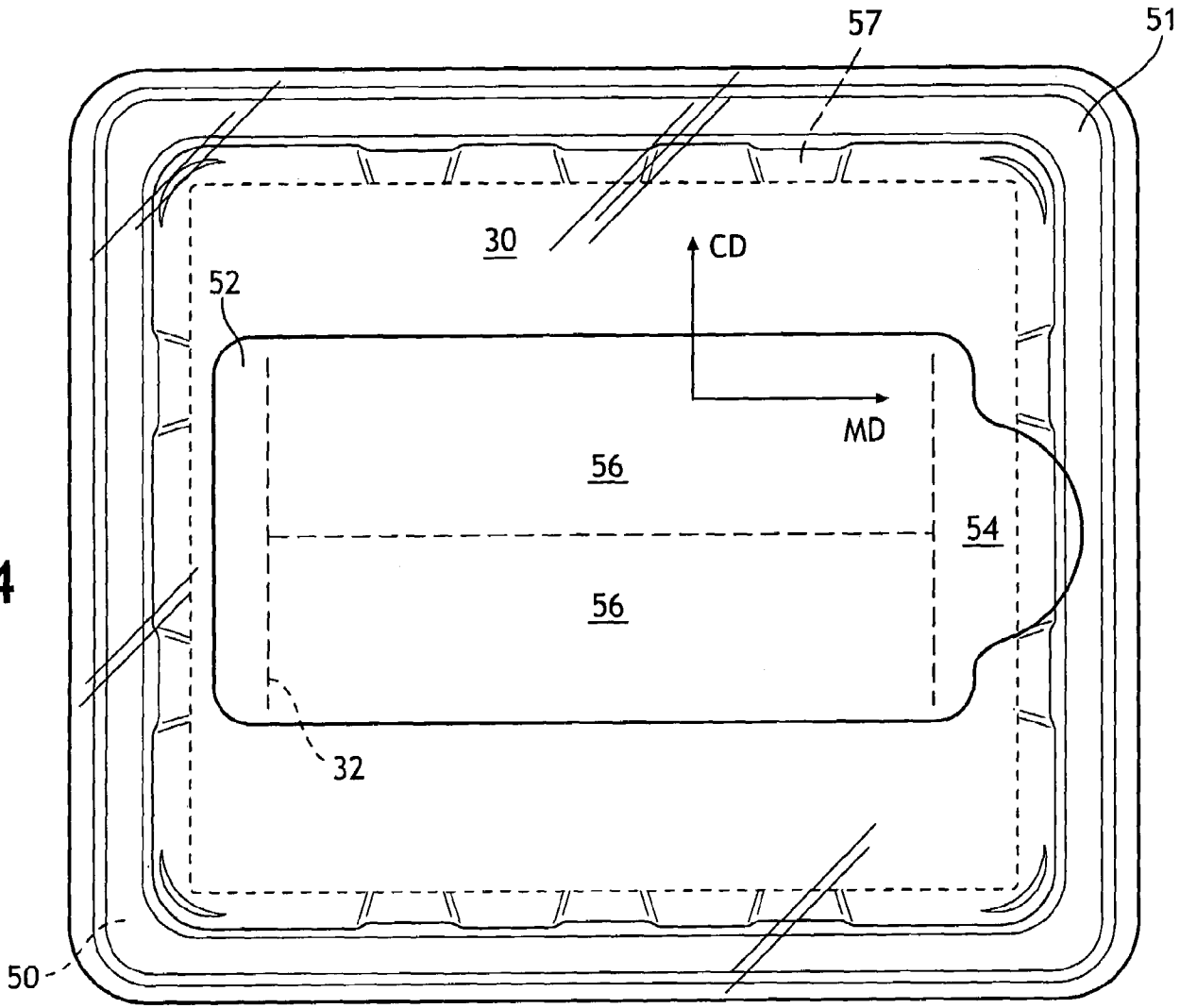
FIG. 4 illustrates a top view of the baffle attached to the interior tub.

Referring to FIGS. 3 and 4, the interior tub 28 includes a baffle 30 having an aperture 32. Disposed within the interior tub is a stack 34 of wet wipes. The interior tub can include an upper flange 50 for attaching the baffle to the interior tub. At least a portion of the baffle 30 is attached to the interior tub. Desirably, the baffle's perimeter 51 is attached to the upper flange 50 of the interior tub. The baffle can be attached by heat sealing the baffle to the interior tub, ultrasonically sealing the baffle to the interior tub, or adhesively attaching the baffle to the interior tub.

In one embodiment, the interior tub 28 or upper flange 50 is tapered such that the interior tub can be easily inserted into the outer carton 24, but as the interior tub is progressively inserted into the outer carton, the clearance between the interior tub and the outer carton decreases or becomes a slight interference fit. In this manner, the interior tub can be prevented from shifting or moving about inside of the outer carton. For example, the upper flange can have a radius or curvature on two or more opposing sides such that the middle of the flange between the ends of the interior tub is wider than the flange's width at either end. When the interior tub is constructed in this manner, the ends of the interior tub are easy to insert into the outer carton, but when fully inserted, the larger radiused portion of upper flange can press against the outer carton to prevent shifting. Alternatively, the interior tub can be attached or glued to the outer carton to prevent shifting or movement.

The baffle 30 attached to the interior tub can help to separate one wipe from the next to eliminate sheet follow and multiple dispensing. The baffle is also designed to act as an extra moisture barrier to keep the wipes moist even if the rigid flip top is accidentally left open. Desirably, the baffle material springs back to cover the entire opening into the interior tub, leaving only a small slit so as to decrease the amount of open area available to evaporate the wetting solution. Depending on the aperture 32 selected and the specific baffle material utilized, the aperture or slit can be designed to allow for a larger area when retrieving a wipe and then spring back to a closed or substantially closed position. This can significantly reduce the moisture loss from the wipes while stored in the container. If the baffle is clear or translucent, it can allow consumers to see into the tub's interior to gage how much of the product remains.

As mentioned, one advantage of the baffle 30 is to help retain moisture of the wet wipes in the interior tub. Depending on the supply chain logistics, the interior tub, with its stack of wipes, can be fabricated at a different time and/or place and then stored for later use with different outer cartons having various graphic designs. Thus, multiple interior tubs with wetted wipes can be produced and stored for later insertion into outer cartons as demand necessitates. In this manner, changing the outer carton's graphics and/or supplying more than one graphical pattern can be readily facilitated since a common interior tub is used. If a more expensive or desirable outer carton graphical treatment is produced, the outer carton can be adapted to be refilled with the common interior tub. For example, an outer carton using holographic, lenticular, or metallized films can be expensive to produce and may be better suited to being designed for refilling with a new interior tub and wipes instead of disposing of the whole container and buying a new one. In this manner, the outer carton can be reused upon depletion of the wet wipes.

Alternatively, the container 30 with the interior tub 28 inserted can be stored for long periods prior to using the wet wipes. While the interior tub or container is stored, it is desirable to have an air tight or substantially air tight package. One means of achieving that is to only perforate or score the aperture's outline 32 in the baffle rather than create the entire slit to form the aperture. In this manner, the baffle will be substantially air tight. Because the aperture is initially formed from score lines, perforations, laser scoring, or other lines of weakness, it can be readily punctured to retrieve the first wipe. By forming the baffle with score lines or perforations, it can be easier to determine if the product has been tampered with, since it is likely the score lines will have been broken.

To further prolong the storage life of the wipes, an optional label or labels 52 can be applied to the baffle 30 covering the entire baffle, the entire aperture 32 or a portion of either the baffle or the aperture. For example, one continuous label can be used to cover a majority of the baffle. A possible disadvantage to one large label is that the label may be difficult to remove through the opening in the rigid flip top 26. Alternatively, the larger label can be scored, cut, perforated or weakened such that it can be removed in two or more smaller pieces. This can be more convenient especially if a relatively large label is used with a smaller rigid flip top opening.

Suitable label materials include polyethylenes, polypropylenes, polystyrenes and extruded co-polymers available in white, clear, metallized, gloss, and matte. Standard constructions range from about 0.5 mil to about 5 mil gauges. In one embodiment, the label was a polyolefin base material for the face stock. The polyolefin was a blend of polyethylenes and polypropylenes, including some recycled films. The face stock was then printed and a clear overlaminate of polypropylene was placed on top of the printed face stock to protect the printing. The overlaminate can be adhesive backed.

The label 52 can be removably affixed to the baffle by a pressure sensitive adhesive. One common adhesive used in the industry to attach labels to a package is a solvent based acrylic adhesive. If desired, certain areas on the adhesive side of the label can be printed with a UV coating. Wherever the UV coating is applied, the acrylic adhesive is covered and the surface is no longer tacky.

To make removal of the label easier, a tab 54, or tabs if a multi-piece label is used, can be formed on one or more edges of the label. The tab 54 can be left unattached to the baffle making it easier to quickly remove the label from the baffle 30 to dispense the wet wipes. As discussed, the tab can be printed with the UV coating to prevent the tab from sticking to the baffle. With the label affixed and the baffle attached to the interior tub 28, the interior tub can be made air tight or substantially air tight.

Another advantage of the label 52 is to preserve the uniformity of the baffle when heat sealing the baffle to the interior tub. Depending on the type of material selected for the baffle, it may warp or wrinkle during attachment to the interior tub 28 or upper flange 51; especially, if the baffle is heat sealed to the interior tub. The label can act to reinforce the baffle during attachment to the interior tub, helping to keep it flat, and can act as an insulator protecting the baffle from the heat sealing element. Additionally, the label can reinforce the baffle during shipping/transport to prevent a perforated aperture 32 from being accidentally broken open. The size of the label can be adjusted as needed to provide the level of necessary reinforcement, heat rejection, and/or air tightness. For example, the baffle's outer perimeter 51, that in one embodiment is heat sealed to the upper flange 50, can be protected by a label that covers the outer perimeter, and/or other portions of the baffle, protecting the baffle from the heat sealing element. Alternatively, the label can cover only the aperture 32 or a substantial portion of the aperture.

Another advantage of the baffle 30 is to aid in moisture retention of the wipes within the container 20. Depending on how the outer carton 24 is fabricated, the outer carton may not be as air tight as desirable. To make the outer carton air tight, optional coatings can be applied to the paperboard to decrease its air permeability and the closing flaps can be securely glued to improve or eliminate air permeability of the carton. However, even if the outer carton is impermeable, by having an additional moisture barrier in the form of a baffle, the wet wipes in the container will stay wetter if the rigid flip top 26 is inadvertently left open. This can be useful with adults or children who may forget to close the rigid flip top. A properly designed baffle can keep the wipes moist for an extended period of time even if the rigid flip top is left open.

In one embodiment, the stack 34 of wet wipes in the interior tub was not interfolded and the container 20 was designed for reach-in dispensing of the wipes. For reach-in dispensing, it is important that the baffle 30 and its aperture 32 are designed such that fingers or a portion of the hand can be inserted into the tub's interior to retrieve a wet wipe. For this operation, a relatively large opening is desired. However, to retain moisture, the aperture's open area should be as small as possible such that the wipes stay moist for an extended period of time, even if the rigid flip top cover is left open.

Figure 5A:
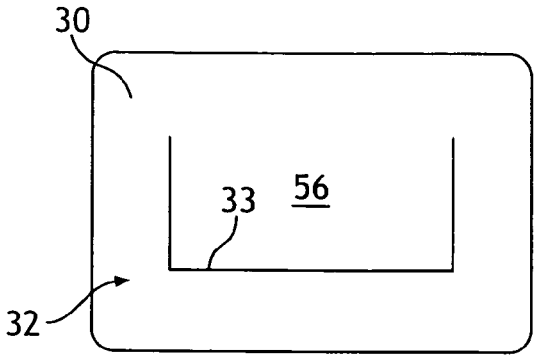
FIGS. 5A-5F illustrate a top view of alternative baffles for use with the interior tub.
Figure 5B:
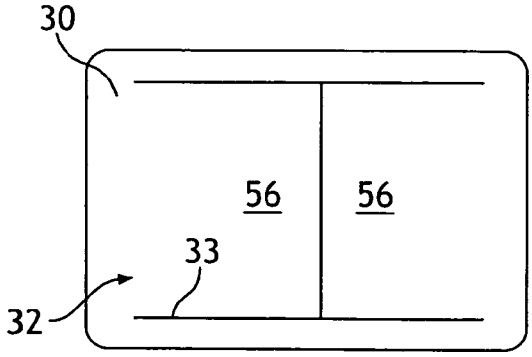
Figure 5C:
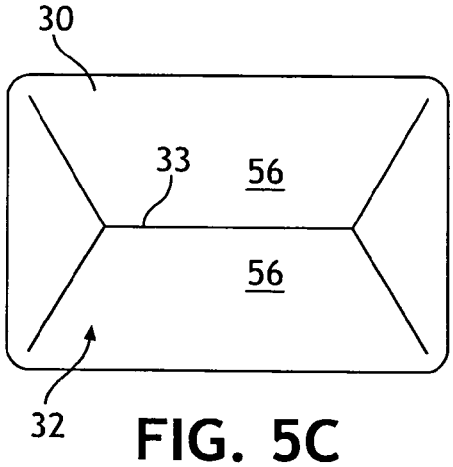
Figure 5D:
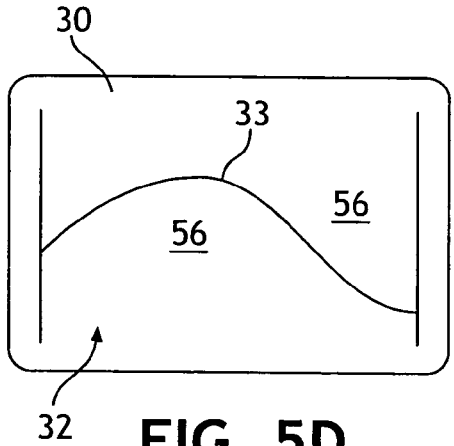
Figure 5E:
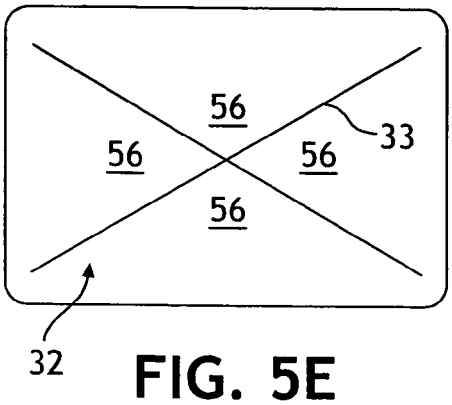
Figure 5F:
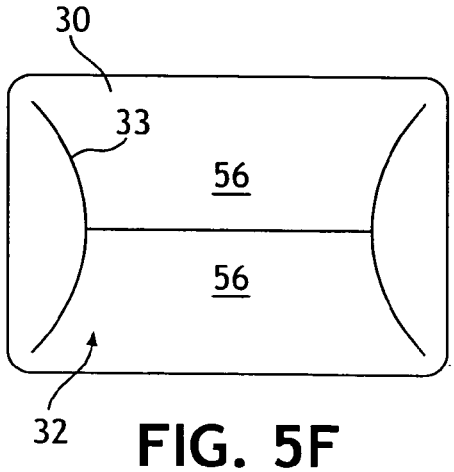
Figure 6:
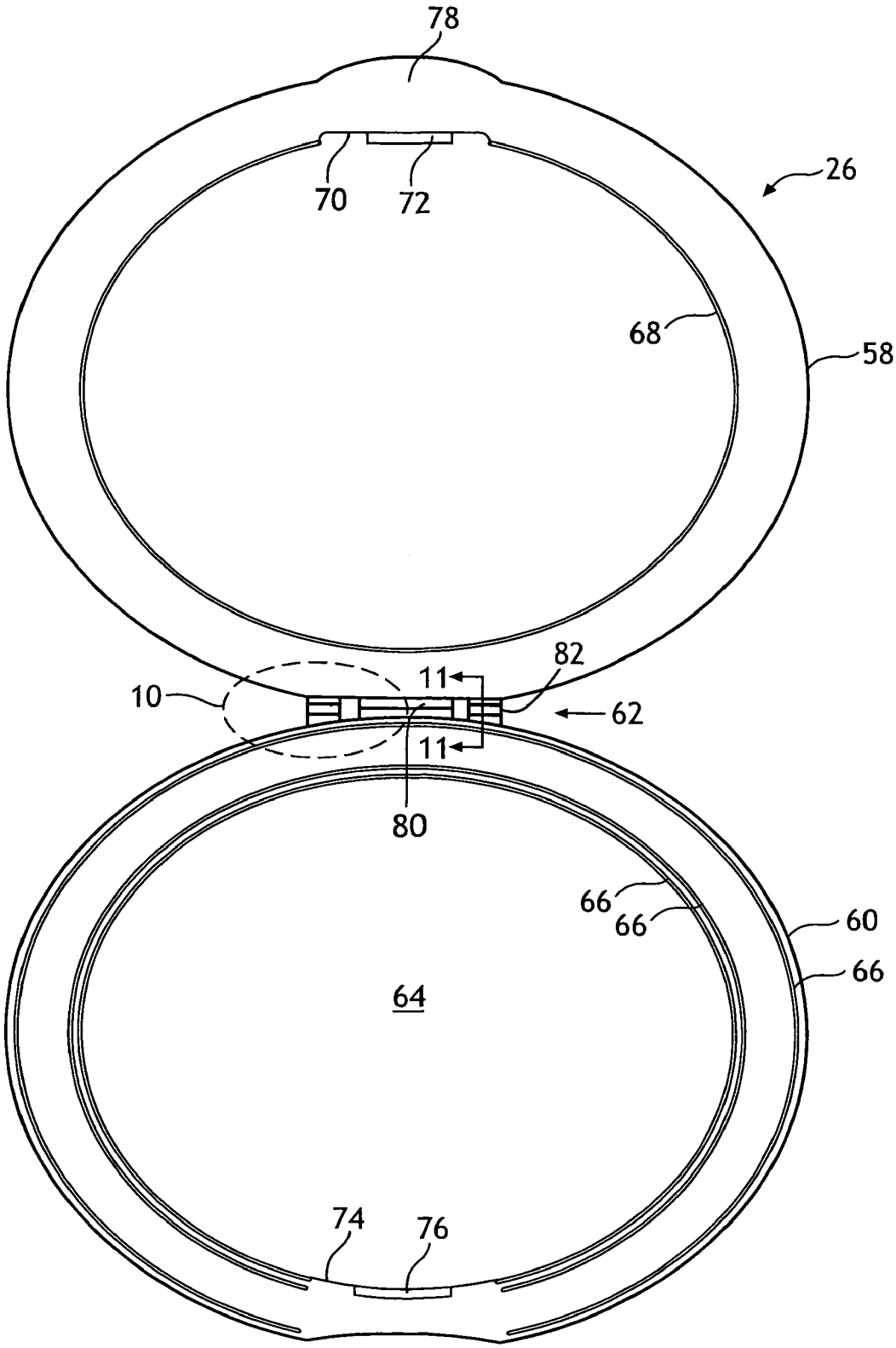
FIG. 6 is a plan view of the rigid flip top in a fully opened position.
Figure 7:
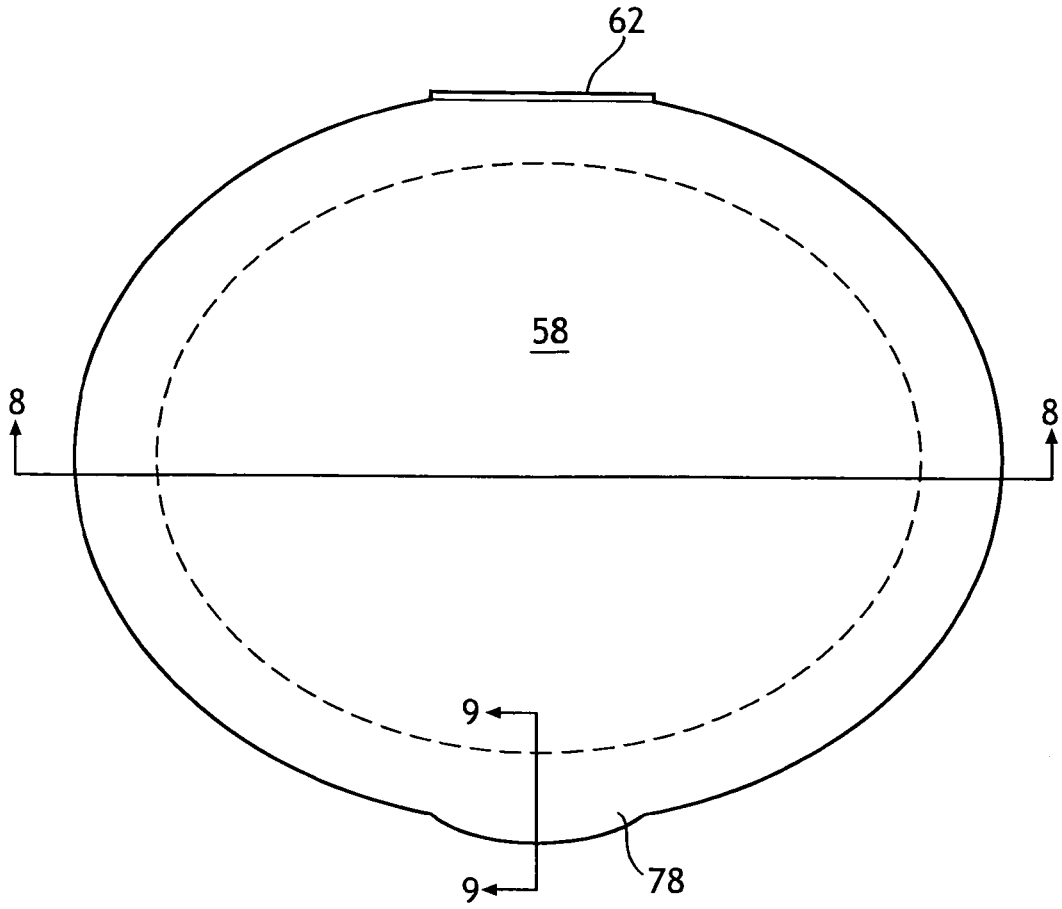
FIG. 7 is a plan view of the rigid flip top in a closed position.
Figure 8:
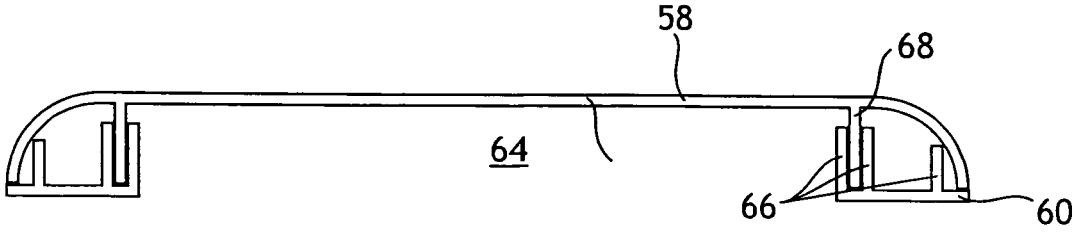
FIG. 8 is a cross-section view taken along line 8-8 of FIG. 7.
Figure 9:
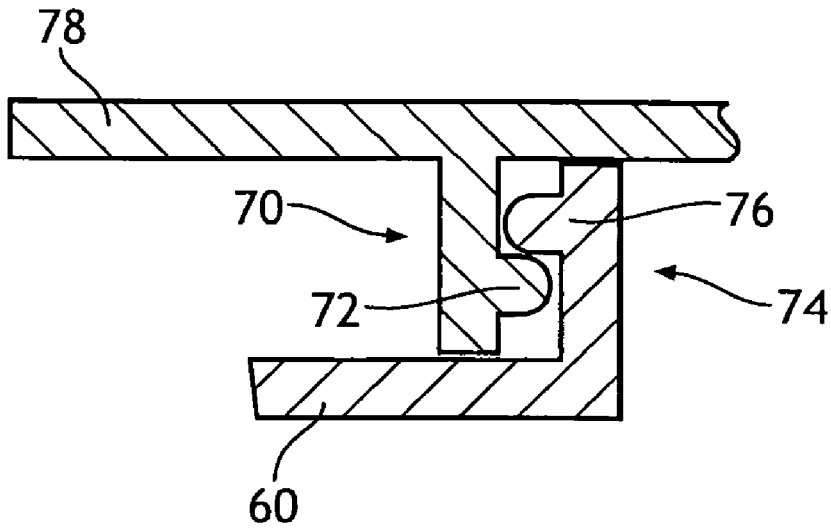
FIG. 9 is a cross-section view taken along line 9-9 of FIG. 7.

Referring to FIGS. 5A-5F, one method of satisfying these demands is to design the aperture 32 as one or more interconnected slit(s) 33, forming dispensing flaps 56, that can open into a larger aperture and then spring back into a closed slit. As seen, the aperture 32 can be U-shaped (FIG. 5A), H-shaped (FIG. 4 and SB), modified H-shaped (FIG. 5C), horizontally curvilinear H-shaped (FIG. 5D), X-shaped (FIG. 5E), or vertically curvilinear H-shaped (FIG. 5F). If desired, the slit(s) for any of these designs or for other designs can terminate in a circular hole to prevent the slit from propagating by stress fracturing. By designing the aperture 32 to form one or more dispensing flaps 56, the dispensing flaps' flexibility can be controlled to readily move out of the way to allow for the insertion of fingers or a hand and then spring back to a closed or substantially closed position.

The baffle 30 is constructed from a suitable flexible material to enable the dispensing flaps 56 to readily flex as required and then spring back into a closed position or substantially closed position. Additionally, the material should not be too stiff such that it is painful or difficult to insert fingers or a hand into the interior tub 28 to retrieve a wipe. Since the baffle will be subjected to humidity or wetness on at least one side, it is desirable for the material to not curl or deform when subjected to high levels of humidity or moisture. Additionally, the aperture 32 and/or dispensing flaps 56 can be specifically aligned with regard to the MD and CD orientation of the baffle material. Certain baffle materials can have more of a tendency to curl in one direction more than the other direction if slit or cut. In one embodiment, the center portion of the H-shaped aperture 32 was aligned with the baffle's MD direction and the legs of the H-shaped aperture were aligned with the baffle's CD direction as shown in FIG. 4.

Suitable materials for constructing the baffle include typical laminated films constructed of HDPE, High Density Polyethylene and PET, Polyethylene Terephthalate. In one embodiment, the baffle was a laminated structure of 5.5 mil HDPE combined with 0.48 gauge PET. The skin layer of PET can be used to prevent the baffle from sticking to the heat sealing element in addition to, or instead of, a label covering the baffle. Other materials include films which are not of a laminated structure, but rather a homogeneous blend of suitable polymers that can be sealed to the interior tub. For example, if a HDPE interior tub material is used, then a HDPE homogeneous baffle material can be utilized.

If the baffle is made from a film material, the thickness of the film should be controlled to control the flexibility of the dispensing flaps 56 within a desired range. If the material is too thin, the dispensing flaps tend to sag, especially in the humid environment of the interior tub. If the material is too thick, flexibility can suffer when attempting to insert fingers or a hand to retrieve a wipe. It is desirable to have one-handed dispensing such that a person's fingers or hand can be inserted and withdrawn from the container easily without having the container become stuck on the person's hand or pinching the person's fingers. In various embodiments of the invention, the baffle's thickness can be between about 4 mil to about 35 mil, or between about 4 mil to about 15 mil, or between about 4 mil to about 10 mil.

The MD secant modulus of the film as tested by ASTM D 882-02 Standard Test Method for Tensile Properties of Thin Plastic Sheeting is another factor that should be controlled to enable better spring back and/or less curl of the dispensing flaps. The secant modulus is a measure of the intrinsic stiffness of a piece of film. It is the ratio of the MD stress to the MD strain over a range for which this ratio is constant, i.e. the initial slope of the stress-strain curve. The secant modulus is related to the resistance of a piece of film to distortion and is related to the force that is required to deform the film by a given amount. In various embodiments of the invention, the MD secant modulus can be between about 7,000 psi to about 200,000 psi, or between about 25,000 psi to about 200,000 psi, or between about 100,000 psi to about 175,000 psi.

The interior tub 28 is made from a liquid impervious material. Suitable interior tub materials can include HDPE, Polypropylene, Polystyrene layered films, Polyethylene, or other typical polymers used in the packaging industry for contact with solutions typically used with wet wipes. The interior tub can be thermoformed, vacuum molded, injection molded, blow molded, or manufactured by other methods. The interior tub can also be formed from a foamed polymer to increase the wall thickness and rigidity or to save weight or material.

Figure 12:
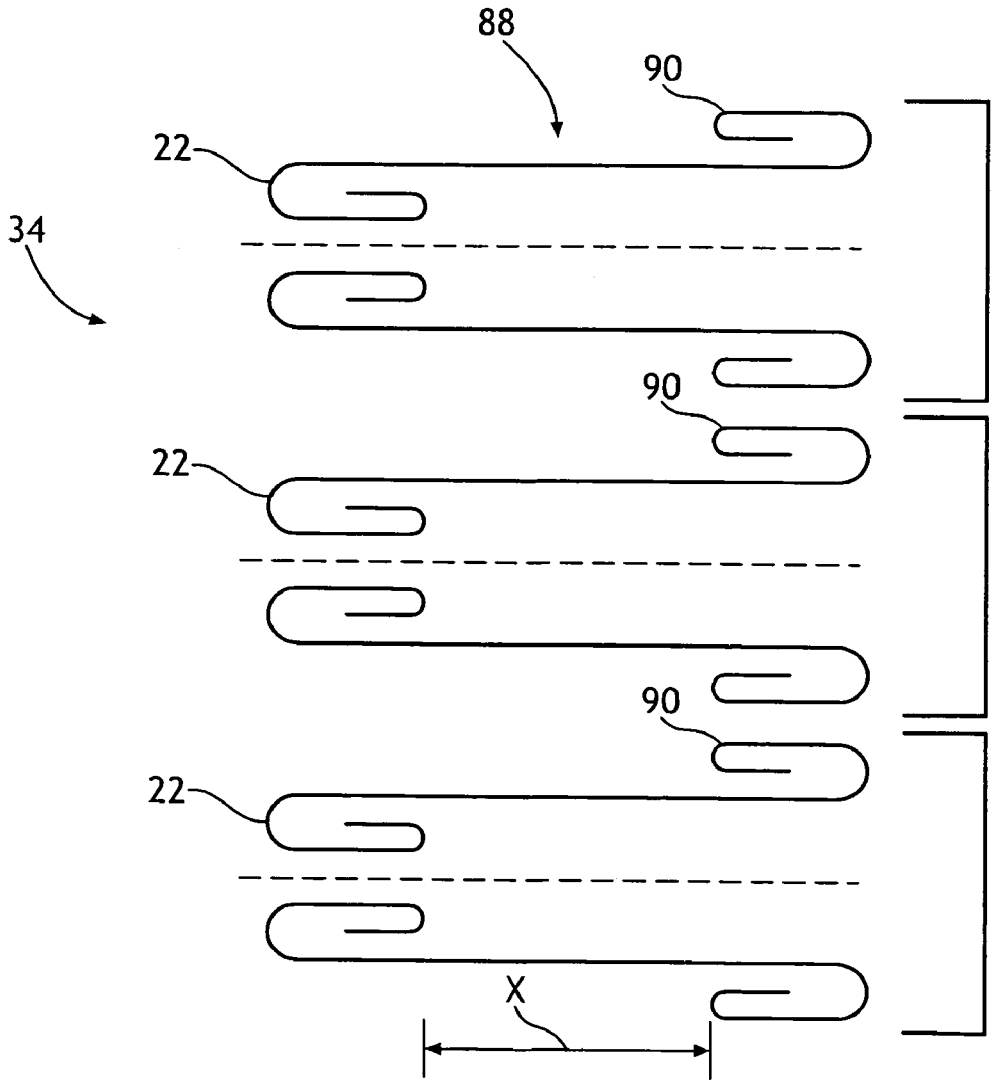
FIG. 12 is an end view of a stack of wipes longitudinally folded into a balanced double J fold and then transversely folded in half.

The interior tub 28 can have molded ribs 57 or other stiffening elements to stiffen the interior tub and/or to prevent the stack 34 of wet wipes from shifting within the interior tub. For example, depending on how the wipes are folded, the stack of wipes could have a groove or depression where fewer layers of material are present in the stack. As seen in FIG. 12, the center of the stack has fewer layers than either J-folded edge. To prevent the heavier J-folded edges from buckling the middle layers of the stack, the interior tub can be designed with vertical ribs that engage the middle of the stack on each end, helping to keep the heavier J-folded edges separated. Such a feature can be useful if the container 20 is shipped on its side instead of upright as shown in FIG. 1.

The interior tub 28 of the present invention can include any suitable number of individual wet wipes 22, depending upon the desired packaging and end use. For example, the interior tub can be configured to include a stack of wipes that has at least about 5 wipes, desirably between about 8 to about 320 individual wipes, and more desirably between about 20 to about 100 wipes.

Rigid Flip Top

A rigid flip top 26 is attached to the outer carton 24 over the opening 42 in the carton. A suitable rigid flip top is disclosed in U.S. patent application Ser. No. 10/729,486 entitled Storing and Dispensing Container for Product, filed on Dec. 5, 2003, by Fred Buck et al. and incorporated herein by reference.

Referring to FIGS. 6-11, the rigid flip top 26 includes a lid 58 connected to a flange 60 by a hinge 62. The flange can be affixed to an outer surface of the outer carton 24 such that the rigid flip top overlies the opening 42 into the carton's interior. The flange 60 forms a dispensing orifice 64 through which the product can be dispensed when the lid is opened. The flange 60 can include three flange annual sealing rings 66 and the lid can include one lid annular sealing ring 68. As seen, the lid annular sealing ring can engage between two of the flange annular sealing rings. The third flange annular sealing ring can engage with the lid's perimeter. Alternatively, more or less sealing rings can be used or the position of the sealing rings can be reversed. It is not necessary for the annular sealing rings to completely encircle the dispensing orifice 64. The lid 58 is positionable to engage with the flange 60 and thereby close the outer carton, reducing or eliminating moisture loss of the wet wipes.

The lid 58 can include a latch 70 with an elongate first rib 72 projecting horizontally, and the flange 60 can include a catch 74 with an elongated second rib 76 projecting horizontally. The first and second ribs 72 and 76, respectively, can removably engage each other in an interference fit to maintain the lid closed and removably disengage each other when the lid is opened. Alternatively, either the first or the second rib can be replaced by an aperture or detent for the other corresponding rib to engage with. The lid can include an opening tab 78. The opening tab protrudes from the rigid flip top 26 so that a user can easily find it and have an identifiable leverage point to open the lid.

The hinge 62 can be designed to have a snap-open and snap-closed action. The hinge can be a living hinge, where "living hinge" is defined herein to mean a hinge formed integrally with the members it is between such as between the lid 58 and the flange 60. The hinge can include a central strap 80 and a pair of toggle straps 82, with each toggle strap located on an opposite side of the central strap. Advantageously, the hinge enables the lid to move throughout a first open position (e.g., from about 0 degrees defined relative to a horizontal plane, to about 80 degrees defined relative to the same horizontal plane). Then, moving the lid past the first open position requires overcoming a force (i.e., a stress release point anywhere from about 65 degrees defined relative to the same horizontal plane to about 115 degrees defined relative to the same horizontal plane) created by the central strap and the pair of toggle straps. When the force is overcome, the lid is maintained in a second open position (i.e., anywhere past the stress release point). To move the lid from the second open position to the first open position requires that the force be overcome in a reverse direction than when moving the lid from the first open position to the second open position.

Without being limited to a theory of understanding, the snap-open and snap-closed action which defines the first and second open positions is believed to operate as follows. The central strap 80 creates a pivot axis midway between its ends connected to the lid and the flange, and as such acts very much like a mechanical hinge. The toggle straps 82 are located on either side of the central strap and are located in a different horizontal plane than the central strap (e.g., seen in FIG. 11 where the central strap 80 is in a horizontal plane above a horizontal plane containing the toggle straps 82). By nature of the rigid flip top's elliptical geometry, the toggle straps span a greater distance than the central strap; and from a side view when the lid is closed, the toggle straps are positioned further outside the perimeter of the rigid flip top than the central strap. As such, when the lid is closed the toggle straps are under mild compression. As the lid is opened, the toggle straps' horizontal pivot axis moves toward the central strap's horizontal pivot axis. As this happens, the toggle straps are under increased tension and stretch until the toggle straps' horizontal pivot axis moves past the central strap' s horizontal pivot axis and the toggle straps' horizontal pivot axis moves into a relaxed, as originally-formed, position. This movement produces a spring/snap action as the tension on the toggle straps increases, peaks and then rapidly decreases through the range of movement from the lid being closed to being fully opened.

Figure 10:
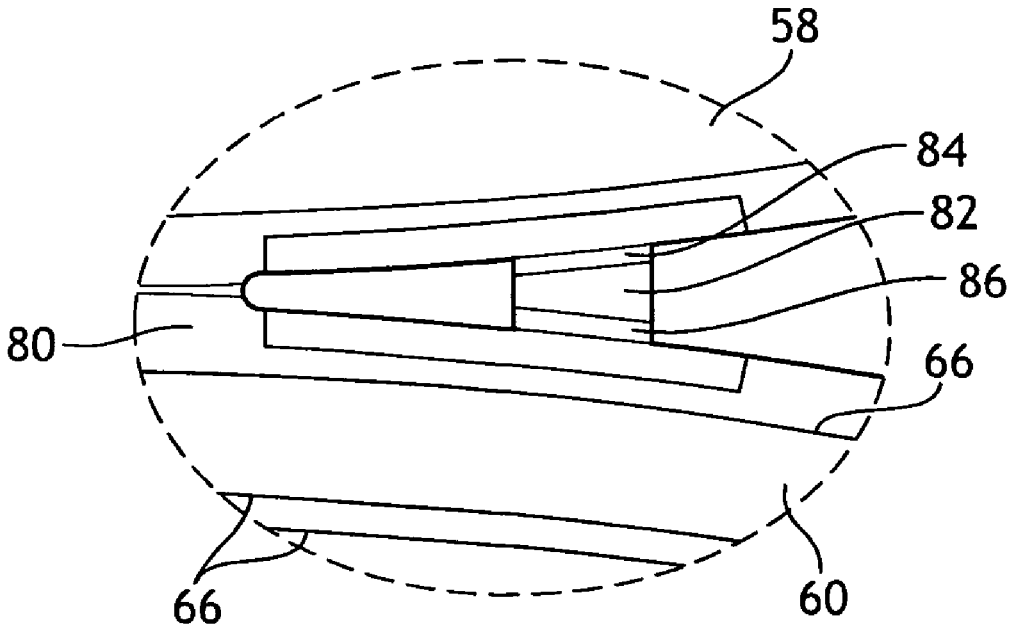
FIG. 10 is a close up view of the hinge contained in the dotted circle of FIG. 6.
Figure 11:
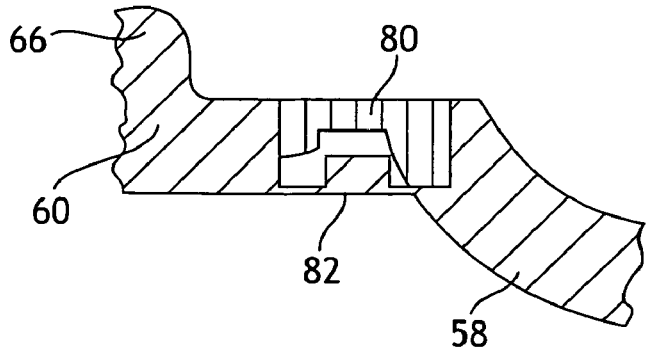
FIG. 11 is a cross-section view taken along line 11-11 of FIG. 6.

More particularly, as best seen in FIG. 10, the hinge 62 can be defined where at least one toggle strap 82 includes a pair of channels with a first such channel 84 located at a first end of the strap adjacent the lid 58 and a second such channel 86 located at a second end of the strap adjacent the flange 60. In this way, the toggle straps pivot at their ends as opposed to in their middle like the central strap 80, which can be further advantageous to the snap-open and snap-closed action.

The rigid flip top can be attached to the carton by various mechanical and chemical methods known in the art, including, but not limited to, the use of glue or other bonding material, or through mechanical joining methods such as a snap fit, tabs inserted into slots, or the carton snapping into a grove in the flange. The rigid flip top can be made by a variety of conventional techniques, including for example, injection molding, made from polypropylene, and/or being a single piece with a living hinge.

Wet Wipes

The wipes or wet wipes can be arranged in the interior tub in any manner which provides convenient and reliable one-at-a-time dispensing and which assists the wipes in not becoming dirty and/or overly dry. For example, the wipes may be arranged in a dispenser or container as a plurality of individual sheets arranged in a stacked configuration to provide a stack of wipes which may or may not be individually folded. The wipes may be individual wipes which are folded in a c-fold, z-fold, quarter-fold or other fold or interfolded or non-interfolded configuration as are known to those skilled in the art. Desirably, the container may include a plurality of wipes stacked one on top of each other in a non-interfolded configuration for reach-in dispensing. For such a non-interfolded wipe, each wipe is folded onto itself with no portion of another wipe being positioned between or underneath any portion of the folds of the adjacent wipe(s).

The wet wipes can be any suitable size for their intended use. In one embodiment, the size of the wet wipes prior to folding was approximately 8.5 inches×8.25 inches (215 mm×209 mm). This size is especially useful to better protect hands while wiping, etc., and is larger than other commonly available wet wipes for use on the hands or face.

In one embodiment, the wet wipes were folded into a balanced, double-J-fold, as illustrated in FIG. 12, by creating longitudinal J-folds in the wet wipes such that the folded width was approximately 90 mm. FIG. 12 is an exploded end-view of a partial stack of wipes, with each individual wipe being bracketed. After longitudinally J-folding the wet wipes, the wipes were folded in half transversely (represented by the dashed lines in FIG. 12) such that the balanced, double-J-folds are aligned as shown when viewed from the end. The folded wipe measured approximately 90 mm in width by 115 mm in length. In one embodiment, the individually folded wipes were assembled into a stack of approximately 40 wipes by aligning all the transverse folds at one end of the stack.

As seen in FIG. 12, the balanced, double-J-folded wipes have a center region 88 where there are less layers of material in the folded stack. Adjacent the center region 88, one of the J-folded layers can provide a pick point 90 for grasping an individual wipe for dispensing. If the center region becomes too wide, then the stack can buckle; especially, when the container is stored or shipped on its side. If the center region becomes too narrow, the pick point 90 can be difficult to find since it may overlap J-folds present on the opposite side of the stack. As the gap becomes too narrow and overlaps the J-fold on the opposite side of the stack, the stack height will also grow, limiting the number of sheets that the container can hold. For improved dispensing and/or improved buckling resistance, the center region distance X can be between about 2 mm to about 15 mm, or between about 2 mm to about 10 mm, or between about 3 mm to about 7 mm. In one embodiment, the center region distance X was approximately 9 mm.

In an alternative embodiment, an individual wet wipe 22 was folded into a modified, N-fold as shown in FIG. 13. A stack of wipes was then assembled by alternating the horizontal orientation of each individually folded wipe to form a more uniform stack 34 as shown in the exploded end-view of FIG. 14. FIG. 14 shows four individual wipes bracketed and numbered 1, 2, 3, and 4 with each individual wipe folded as shown in FIG. 13. By alternating the horizontal orientation of the individual wipes, the stack can be prevented from sloping or being skewed from side-to-side.

Alternating the horizontal orientation of the individual wipes can also produce a shorter stack of wipes. This can be an advantage for a reach-in product by permitting a greater number of sheets to be included within a container of a given height. Alternatively, the container's height can be reduced for a given number of wet wipes. Referring to FIG. 14, the number of layers contained in the stack of four wipes is 26. Referring to FIG. 12 the number of layers contained in the stack of four wipes is 30. By extending the middle layers of the modified, N-folded wipe, as shown in FIG. 13, and alternating the individual wipes, as shown in FIG. 14, individual wipes placed onto the stack can nest or abut the upper layers of the preceding wipe. This placement also has a benefit in that a folded edge of the following wipe contacts a folded edge of the previous wipe due to the nesting, which can prevent the stack from buckling. Each time a wipe nests on top of the stack, another layer of the stack can be eliminated. In one embodiment using a 64 gsm hydroentangled wet wipe substrate, disclosed herein, the difference in the stack height between 40 wipes stacked as shown in FIG. 12 as compared to 40 wipes stacked as shown in FIG. 14 was 0.5 inches.

Alternatively, the individual wipes can be interfolded or in other ways interrelated such that the leading and trailing end edges of successive wipes in the stacked configuration overlap for pop-up dispensing. In such a configuration, the leading end edge of the trailing wipe is loosened from the stack by the trailing end edge of the leading wipe as the leading wipe is removed by the user. The wipes can be interfolded to facilitate such dispensing by means known to those skilled in the art.

Yet alternatively, the wipes can be arranged in the container as a continuous web of interrelated wipes which are folded in an accordion-like stacked configuration or a roll. The individual wipes can be connected together along lines of weakness, such as lines of perforations, to ensure that the trailing wipe is in position for grasping by the user after the leading wipe is removed. For example, the wipes can be provided by a continuous web of material which has a series of lines of weakness extending across the width of the web. The portion of the web of material between successive lines of weakness provides each individual wipe. The lines of weakness can be provided by means known to those skilled in the art, such as perforations, indentations, score lines, or cuts in the web of material. For example, the lines of weakness or perforations can be provided in the web of material by passing the web of material between a die cutter roll and an anvil roll. After the lines of weakness have been incorporated into the web of material, the web can then be arranged in a stacked configuration for easy insertion into the interior tub.

Materials suitable for the wipes of the present invention are well known to those skilled in the art. Wet wipes can be made from any suitable material for use as a moist wipe, including meltblown, coform, air-laid, bonded-carded web materials, hydroentangled materials, high wet-strength tissue, and the like, and can comprise synthetic or natural fibers or combinations thereof.

A suitable hydroentangled material is disclosed in U.S. Pat. No. 5,284,703 entitled High Pulp Content Nonwoven Composite Fabric, issued to Everhart et al. on Feb. 8, 1994, and a method of making a hydroentangled material is disclosed in U.S. Pat. No. 5,389,202 entitled Process For Making A High Pulp Content Nonwoven Composite Fabric, issued to Everhart et al. on Feb. 14, 1995. The disclosures of the preceding patents are incorporated by reference herein. In a desirable embodiment, the wet wipe material comprised an approximately 13 gsm (0.4 ounce per square yard) spunbond material that was hydroentangled with a, 51 gsm cellulosic tissue web to form a 64 gsm hydroentangled wet wipe material.

The hydroentangled material is believed to be better suited to a general purpose wet wipe for hands and faces. Unlike coform materials, which can be too thick and retain too much moisture for this application, the hydroentangled material has a cloth-like texture and is especially suited to a post-wetting process while still achieving a substantially uniform distribution of the wetting solution in the stack of wipes. Unlike airlaid materials, which can stick together due to the binder materials utilized when wet, the hydroentangled material easily separates when wet, which is important for reach-in dispensing. Additionally, the high pulp content of the hydroentangled material is more economical than spunlace materials using primarily synthetic fibers. The hydroentangled material is a thin material that is still strong, which can provide a wipe that is moist yet does not readily expel entrained liquid as thicker wipes may when compressed during wiping. The hydroentangled material can also have good stretch properties in both the MD and CD directions contributing to the cloth-like feel.

The Geometric Mean Tensile (GMT) of the hydroentangled material can be greater than other commonly used substrates for making wet wipes. This can produce a stronger more durable wet wipe that resists tearing in use. The GMT is calculated by taking the square root of the product of the average CD tensile multiplied by the average MD tensile. The MD or CD tensile and elongations are tested according to TAPPI test method T 494 om-01 *Tensile Properties of Paper and Paperboard* (*Using Constant Rate of Elongation Apparatus*). In various embodiments of the invention, the GMT can be between about 1.0 lb/in to about 2.5 lb/in or between about 1.3 lb/in to about 2.0 lb/in.

The caliper of the hydroentangled material can be less than other wet wipe substrates, such as coform materials allowing for more wipes to be placed into the container. Suitable coform materials for wet wipes can have a caliper of 0.024 inch or greater. While the caliper can be lower, the functionality of the hydroentangled material is not compromised owing to its higher GMT. The caliper of the hydroentangled material is tested by TAPPI test method T 411 om-97 *Thickness of Paper, Paperboard, and Combined Board*. In various embodiments of the invention, the caliper of the wet wipes can be between about 0.005 inch to about 0.020 inch, or between about 0.010 inch to about 0.020 inch.

The wipes of the present invention can contain a liquid which can be any solution that can be absorbed into the wipes or retained on the surface or within the internal voids of the wipe material. The liquid contained within the wet wipes can include any suitable components which provide the desired wiping properties. For example, the components can include water, emollients, surfactants, preservatives, chelating agents, pH buffers, fragrances or combinations thereof. The liquid can also contain lotions, ointments and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 200 to about 400 weight percent liquid based on the dry weight of the wipe for improved wiping.

Additionally, it has been determined that by controlling the moisture levels within a specific range, improved dispensing of the hydroentangled basesheet can result. Specifically, if the moisture levels become too great, then the hydroentangled basesheet tends to adhere to the next sheet, making it more difficult to remove a wipe from the container. If the moisture levels are too low, then the wipe may be too dry to function effectively as a wet wipe. In various embodiments, the moisture level of the wet wipe can be between about 240 to about 280 weight percent liquid, or between about 250 to about 270 weight percent liquid based on the dry weight of the wipe. At these moisture levels, the hydroentangled basesheet can have improved dispensing over an air laid or coform material at the same moisture levels. These moisture levels can aid in dispensing individual wet wipes from the container by improving one-at-a-time dispensing and reducing sheet adhesion, which can case multiple dispensing.

While the invention has been described in detail with respect to the specific aspects thereof, it will be appreciated that those skilled in the art, upon attaining an understanding of the foregoing, may readily conceive of alterations to, variations of, and equivalents to these aspects. Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to make and use the claimed invention, is not to be construed as limiting the scope of the invention, which is defined by the claims and all equivalents thereto.

We claim:

1. A product comprising:

an outer carton having an opening, the outer carton formed from a material selected from the group comprising paper board, cardboard, or other cellulosic materials;

an interior tub having a baffle and an aperture located in the baffle;

a rigid flip top comprising a lid connected to a flange by a hinge, the flange affixed to an outer surface of the outer carton and the rigid flip top disposed over the carton opening for accessing the interior tub with the flange forming a dispensing orifice when the lid is opened; and a plurality of wet wipes disposed within the interior tub beneath the baffle.

2. The product of claim 1 wherein the baffle comprises polymeric film having a thickness between about 4 mil to about 35 mil.

3. The product of claim 1 wherein the baffle comprises a polymeric film having an MD secant modulus between about 7,000 psi to about 200,000 psi.

4. The product of claims 1 or 3 wherein the baffle comprises a polymeric film having a thickness between about 4 mil to about 15 mil.

5. The product of claims 1 or 2 wherein the baffle comprises a polymeric film having a secant modulus between about 25,000 psi to about 200,000 psi.

6. The product of claims 1 or 3 wherein the baffle comprises a polymeric film having a thickness between about 4 mil to about 10 mil.

7. The product of claims 1 or 2 wherein the baffle comprises a polymeric film having a secant modulus between about 100,000 psi to about 175,000 psi.

8. The product of claims 1, 2, or 3 wherein the outer carton comprises a top, a bottom, and a sidewall having four panels.

9. The product of claims 1, 2, or 3 wherein the aperture comprises an H-shaped slit.

10. The product of claim 9 wherein the H-shaped slit comprises a perforated line prior to dispensing the first wipe.

11. The product of claims 1, 2, or 3 wherein the aperture comprises a curvilinear H-shaped slit.

12. The product of claims 1, 2, or 3 wherein the wet wipes are folded for reach-in dispensing.

13. The product of claim 12 wherein the wet wipes are folded into a balanced, double-J-fold longitudinally and then transversely folded in half.

14. The product of claim 13 wherein the wet wipes comprise a stack having a center region distance X of between about 2 mm to about 15 mm.

15. The product of claim 12 wherein the wet wipes are folded into a modified, N-fold and the horizontal orientation of each wet wipe is alternated to form a stack of wet wipes.

16. The product of claims 1, 2, or 3 wherein the wet wipes are interrelated for pop-up dispensing.

17. The product of claims 1, 2, or 3 comprising a label affixed to the baffle at least partially covering the aperture.

18. The product of claims 1, 2, or 3 wherein the rigid flip top hinge comprises a snap-open and snap-closed action.

19. The product of claims 1, 2, or 3 wherein the rigid flip top hinge comprises a central strap and two toggle straps disposed adjacent the central strap.

20. The product of claim 1 wherein the wet wipes have a moisture level of between about 240 to about 280 weight percent liquid based on the dry weight of the wipe.

21. The product of claim 1 or 20 wherein the wet wipe material comprises a spunbond material hydroentangled with cellulosic fibers.

22. The product of claim 21 wherein the wet wipe material has a GMT of between about 1.0 lb/in to 2.5 lb/in.

23. The product of claim 21 wherein the wet wipe material has a caliper of between about 0.005 inch to about 0.020 inch.

24. The product of claim 1 wherein the outer carton comprises a top, a bottom, and a sidewall; the carton opening is located in the top; and the rigid flip top comprises an area less than the entire outer carton's top.

* * * * *